United States Patent [19]

Bosshard

[11] Patent Number: 4,866,281

[45] Date of Patent: Sep. 12, 1989

[54] IRRADIATION PLANT

[75] Inventor: Ernst Bosshard, Winterthur, Switzerland

[73] Assignee: Sulzer Brothers Limited, Winterthur, Switzerland

[21] Appl. No.: 229,330

[22] PCT Filed: Jan. 5, 1988

[86] PCT No.: PCT/CH88/00002

§ 371 Date: Jul. 6, 1988

§ 102(e) Date: Jul. 6, 1988

[87] PCT Pub. No.: WO88/06340

PCT Pub. Date: Aug. 25, 1988

[30] Foreign Application Priority Data

Feb. 11, 1987 [CH] Switzerland ..... 504/87

[51] Int. Cl.[4] ..... G21K 5/02

[52] U.S. Cl. ..... 250/453.1; 250/455.1; 378/69

[58] Field of Search ..... 250/455.1, 453.1, 454.1; 378/69, 68

[56] References Cited

U.S. PATENT DOCUMENTS 4,018,348 4/1977 Bosshard ..... 250/453.1

FOREIGN PATENT DOCUMENTS 934217 8/1963 United Kingdom ..... 250/453.1

*Primary Examiner*—Jack I. Berman

*Attorney, Agent, or Firm*—Kenyon & Kenyon

[57] ABSTRACT

The irradiation plant comprises an irradiation chamber (1) with a radiation source (2) and a conveyor system. The path taken by each conveyor unit is individually preselectable by control elements secured to the unit. Articles for irradiation are loaded on to conveyor units and brought along tracks (10, 11) and shift devices (8, 8*a*) of two transverse tracks (4, 4A) to and from the irradiation tracks (3). When a radiation track (3) is loaded or unloaded by the shift devices (8, 8A), there is always a shift device (8, 8A) for each transverse track (4, 4A) at each end of the irradiation track (3). Sensors are present at the branches and transitions between the tracks of the conveyor system and are supplied to a control system which ensures that after each process of loading or unloading an irradiation track (3), not more than one of the two facing shift devices (8, 8A) is loaded. By means of this irradiation plant, smaller quantities of differently-irradiated articles can be irradiated simultaneously and the plant seldom needs resetting. Operation of the plant is much more economical than for known irradiation plants.

14 Claims, 8 Drawing Sheets

Figure 1A:
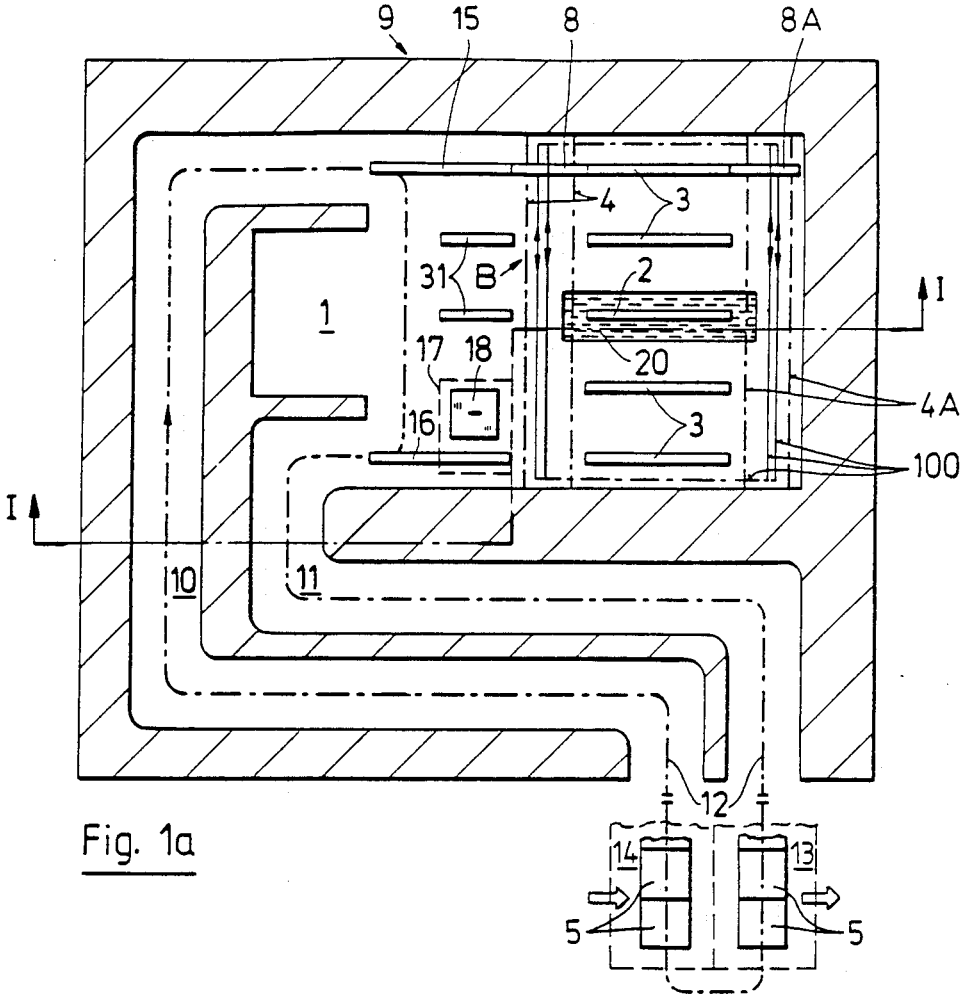

Fig. 3a
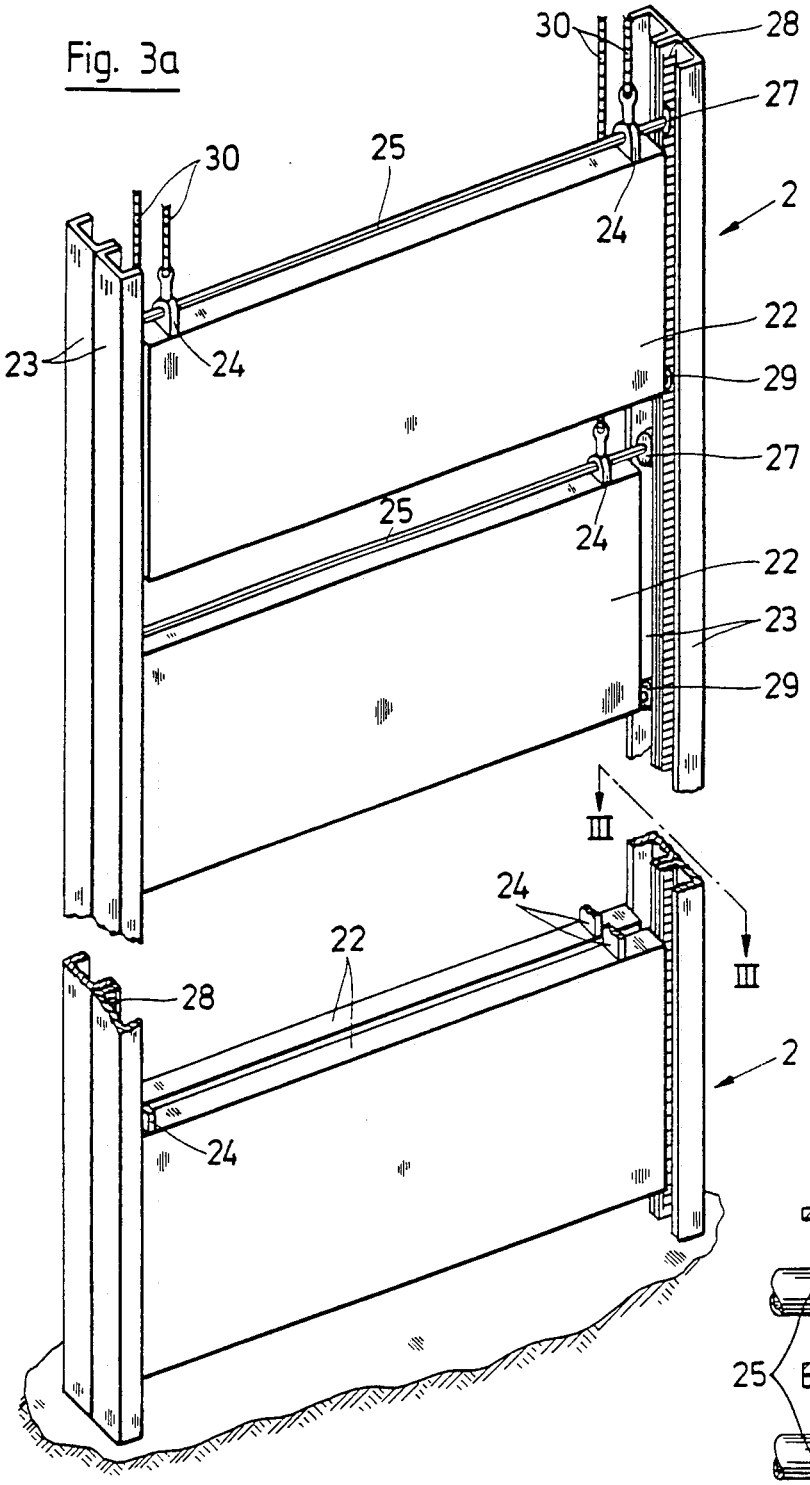
Fig. 3b
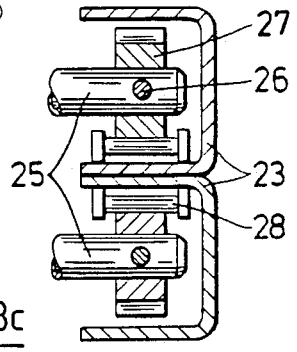
Fig. 3c

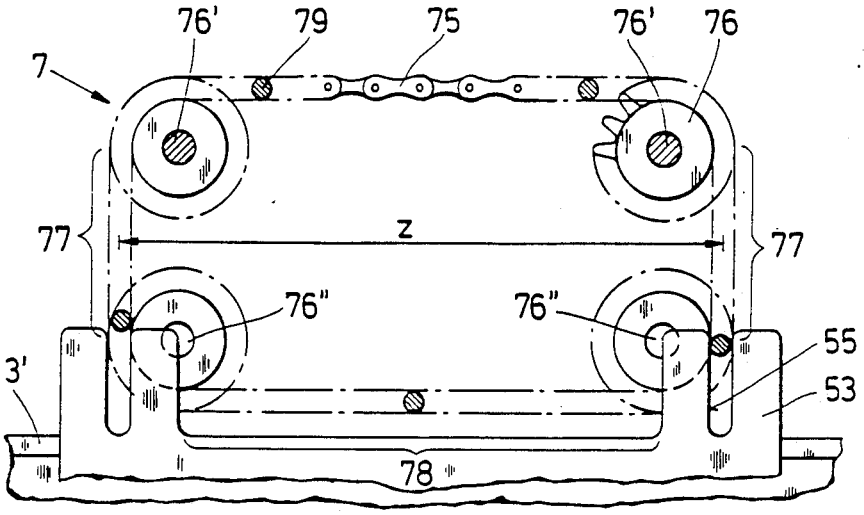
Fig. 6
Fig. 7b
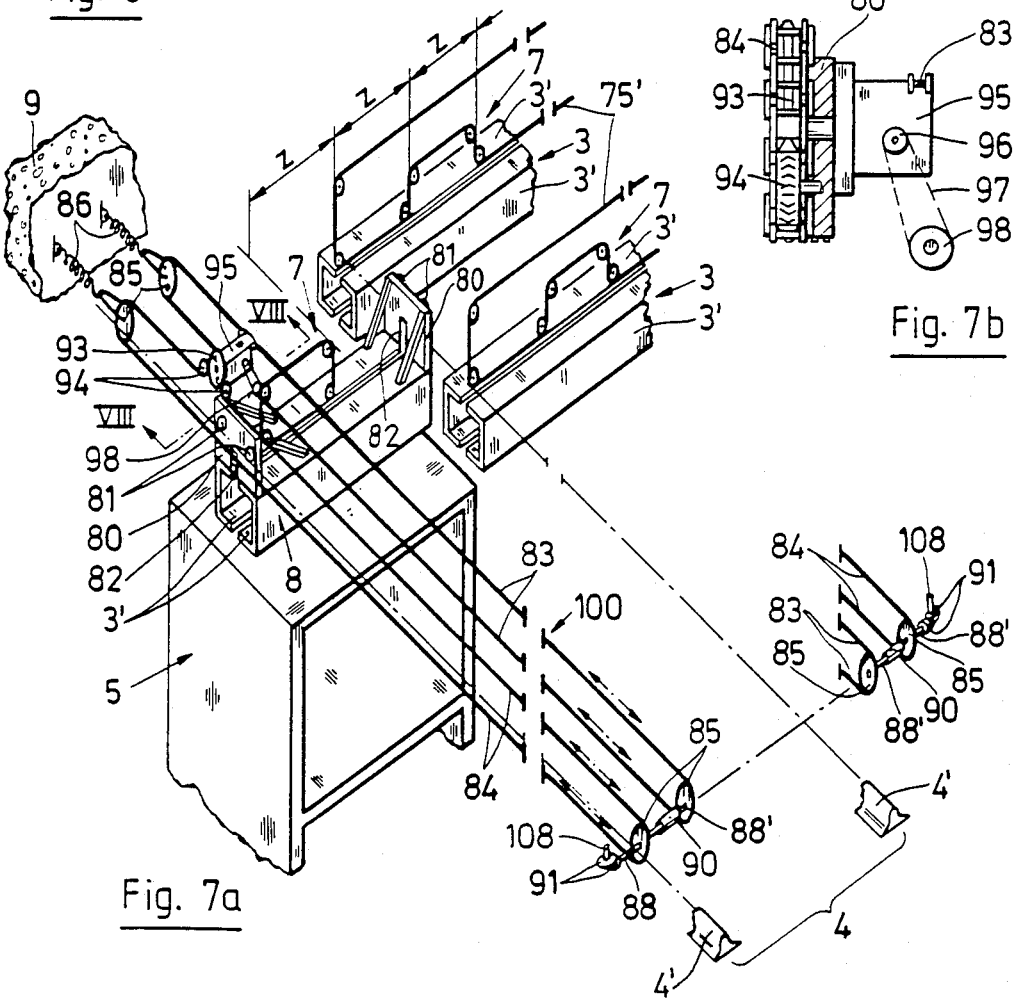
Fig. 7a

IRRADIATION PLANT

The invention relates to an irradiation plant comprising an irradiation chamber and a conveyor system for conveyor units bearing articles for irradiation and moved past a radiation source the system comprising an even number of irradiation tracks disposed symmetrically to the radiation source and extending between a first transverse track and a second track each connecting the irradiation tracks at a respective end, and one transverse track being connected to the entry section and the exit section of the conveyor system to and from the irradiation chamber.

CH-PSS 536 544 and 537 076 disclose an irradiation plant in which articles are irradiated with $\gamma$-rays, e.g. for disinfection or for changing their physical properties. In the known plant, the conveyor units are moved around a radiating wall in batches, during a time preset for each batch and along the same preset path for all conveyor units. If the quantities of articles receiving the same dose of radiation are relatively large, the known device serves its purpose satisfactorily. In this case, since the change from one to another irradiation program does not have to occur too frequently, the operating costs are not excessively burdened by the change-over costs.

It has been found in practice, however, that in many irradiation operations, e.g. in medicine or in the food industry or the treatment of plastics and glass, the article for irradiation often comes in small quantities, so that the irradiation plant can only be inefficiently used and loaded.

In cases where the amounts of irradiated articles are small, the change-over times, as a proportion of the operating times, have a very adverse economic effect on the irradiation plant.

A pamphlet dated June 1983 of Messrs. Atomic Energy of Canada Limited, PO Box 13500, Kanata, Ontaria, Canada discloses a $\gamma$-irradiation plant with a suspended rail track on which the conveyor carriages carrying articles for irradiation are moved batchwise and manually to and from the irradiation chamber. The conveyor carriages and articles are all moved individually through the labyrinth along a single fixed path. A plant of this kind can be dangerous for the operator and requires expensive safety equipment. It is very complicated and uneconomic for the irradiation chamber to be simultaneously filled with articles which have to be irradiated differently. Although the residence time in the radiation area can be controlled by a dosimeter, there is a serious risk in this manually-operated plant that articles will be given the wrong doses of radiation.

An object of the invention is to devise an irradiation plant in which relatively small quantities of differently-irradiated articles can be simultaneously irradiated, so that the irradiation chamber can be efficiently occupied and used even in these cases and the change-over work and time is reduced to an economically acceptable minimum. The irradiation plant must also provide high security for the operating staff. The plant must not need to be entered by staff during operation.

This problem according to the invention is solved by an irradiation plant characterised in that each transverse track comprises a shift device for loading, unloading and changing over the conveyor units on the irradiation tracks and the conveyor units have control elements for presetting the path of the conveyor unit in the conveyor system and acting on sensors of a conveyor-system control means, and the control means is constructed so that whenever a conveyor unit is loaded on to or unloaded from an irradiation track, a shift device is disposed on each side of the conveyor unit, and at the end of each loading or unloading process, not more than one of the two facing shift devices is loaded with a conveyor unit. The dependent claims relate to advantageous further features of the irradiation plant.

The path travelled in the irradiation chamber can be individually preset for each conveyor unit, thus enabling a number of differently-irradiated articles to travel through the irradiation chamber along various tracks depending on the preset irradiation requirement. During the loading and unloading process, only one of the two facing shift devices on the transverse tracks is occupied at one time by a conveyor unit, thus ensuring that the conveyor units run unimpeded along their individual paths through the irradiation chamber.

Figure 1B:
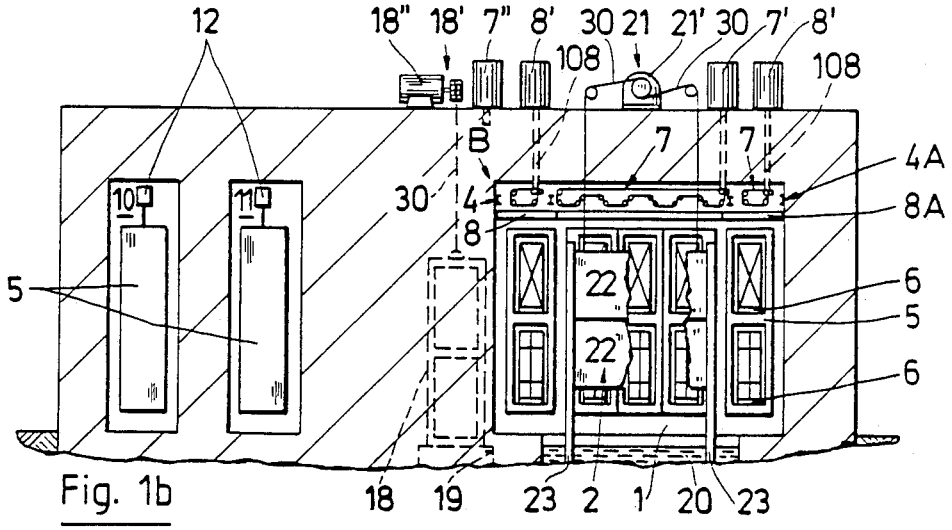
Figure 2A:
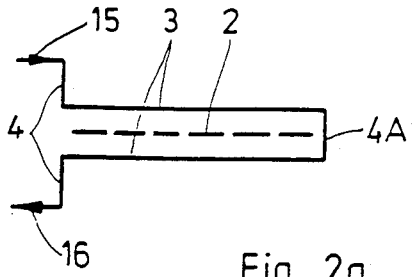
Figure 2D:
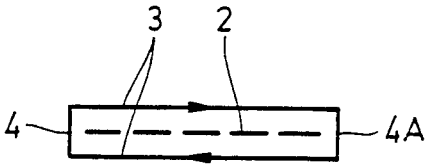
Figure 2B:
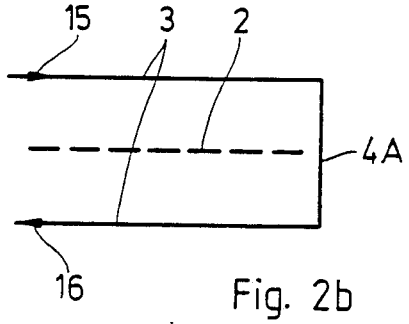
Figure 2E:
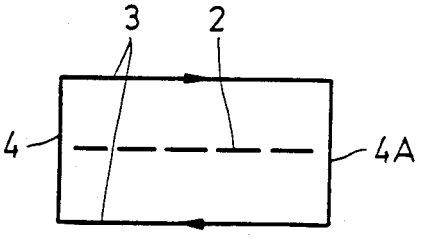
Figure 2C:
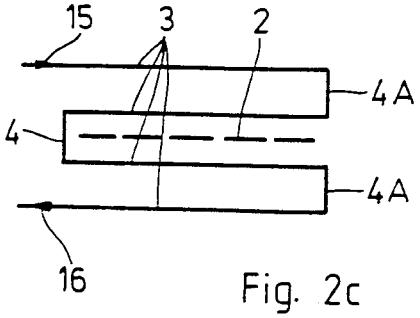
Figure 2F:
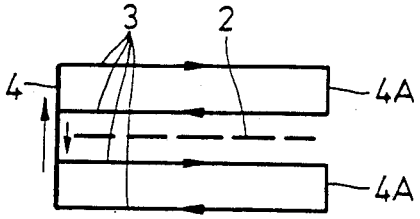

The invention will be explained in detail with reference to the diagrams, which show examples of irradiation plants according to the invention and details thereof. In the drawings:

FIG. 1*a* is a plan view of an irradiation plant according to the invention;

FIG. 1*b* is a side view of the irradiation plant in section I—I of FIG. 1*a;*

FIGS. 2*a* to 2*f* show possible paths along which the conveyor units can run through an irradiation plant according to FIGS. 1*a* and 1*b;*

FIGS. 3*a* to 3*c* are perspective views of arrangements of wall-like irradiation sources and parts thereof, 3*c* being a section through the lateral guide rails along III—III in FIG. 3*b;*

Figure 4:
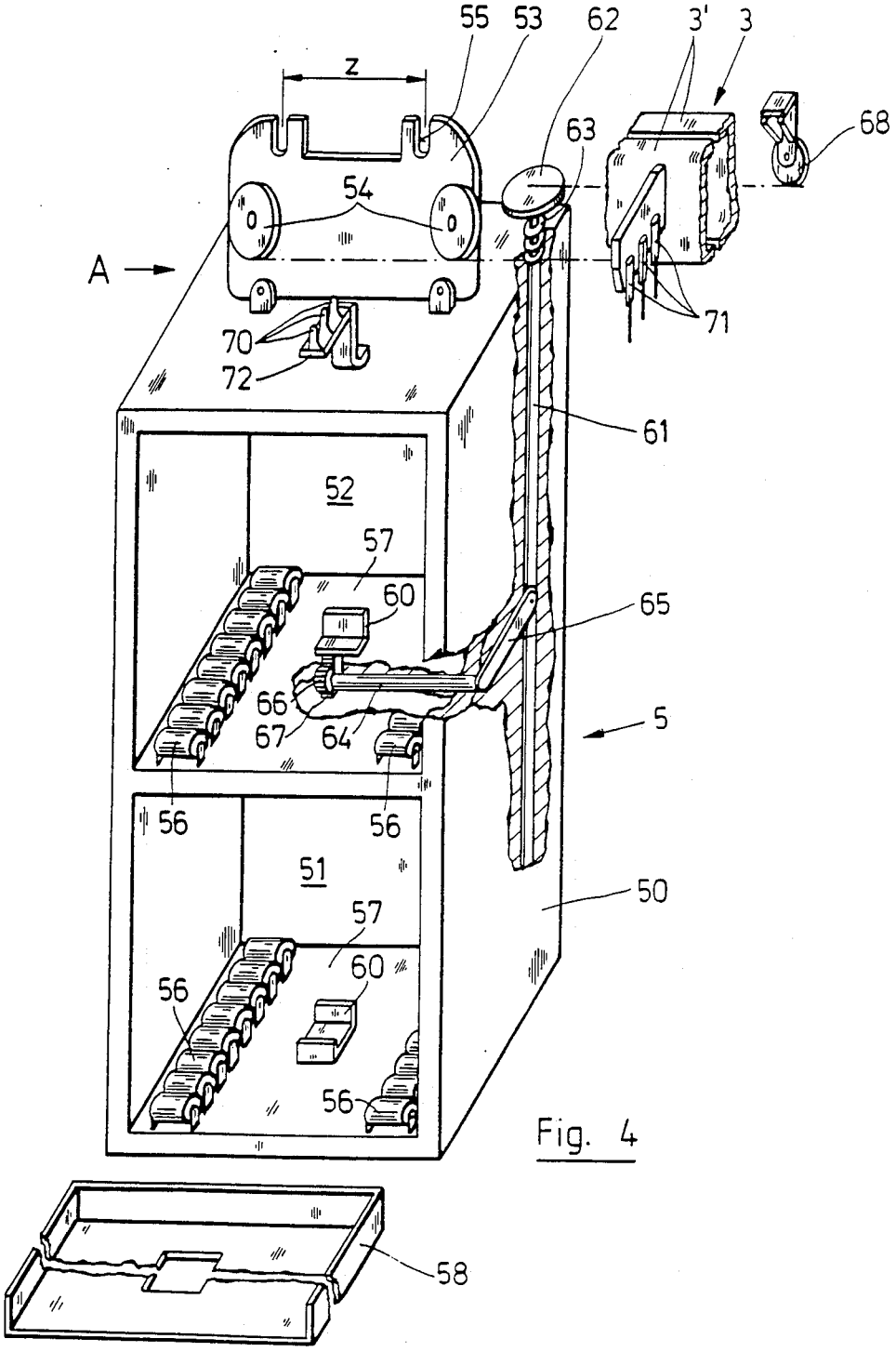
Figure 5A:
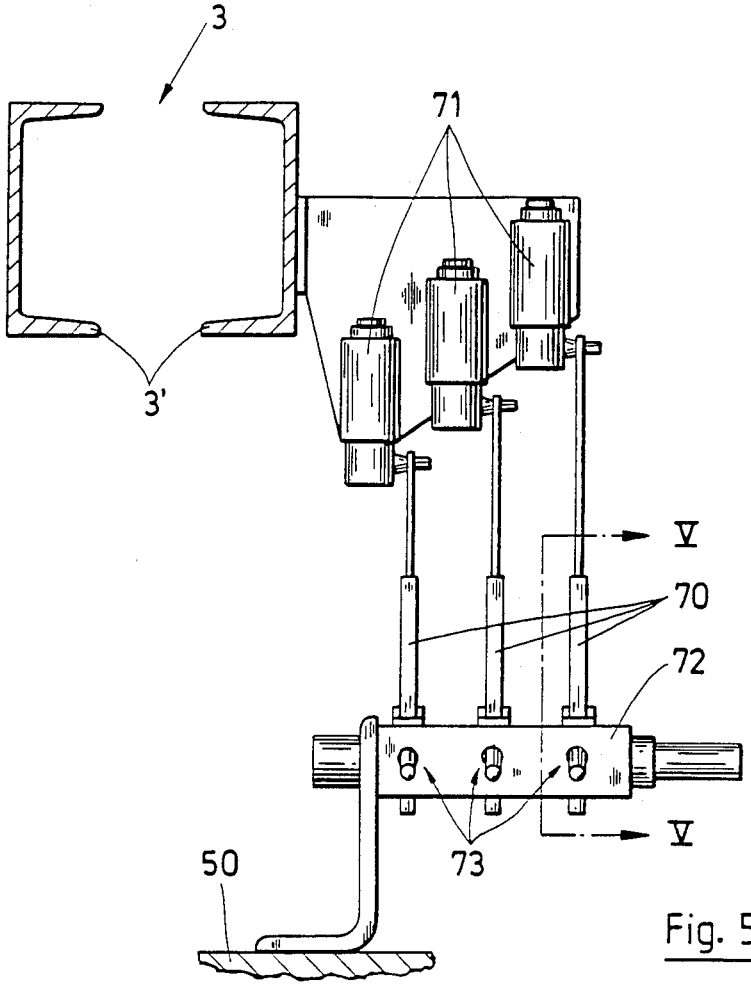
Figure 5B:
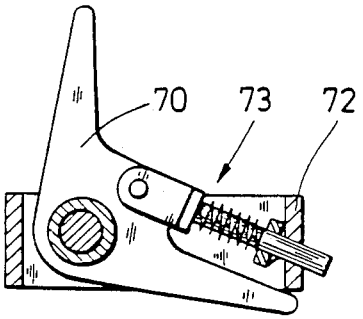

FIG. 4 is a perspective view of a conveyor device for an irradiation track in the form of a suspended track;

FIG. 5*a* shows the control device for a conveyor unit and the control sensors co-operating therewith and disposed along the tracks as per FIG. 4, shown in side view in the direction of arrow A in FIG. 4;

FIG. 5*b* shows the control lever of the control device along section V—V in FIG. 5*a;*

FIG. 6 is a sectional view of details of a chain drive unit for moving the conveyor units on suspended rail tracks;

FIG. 7*a* is a perspective view in the direction of arrow B of units of the drive of the shift device in the conveyor system of the irradiation plant in FIGS. 1*a* and 1*b;*

FIG. 7*b* is a section through the shift device along VIII—VIII in FIG. 7*a;*

Figure 7C:
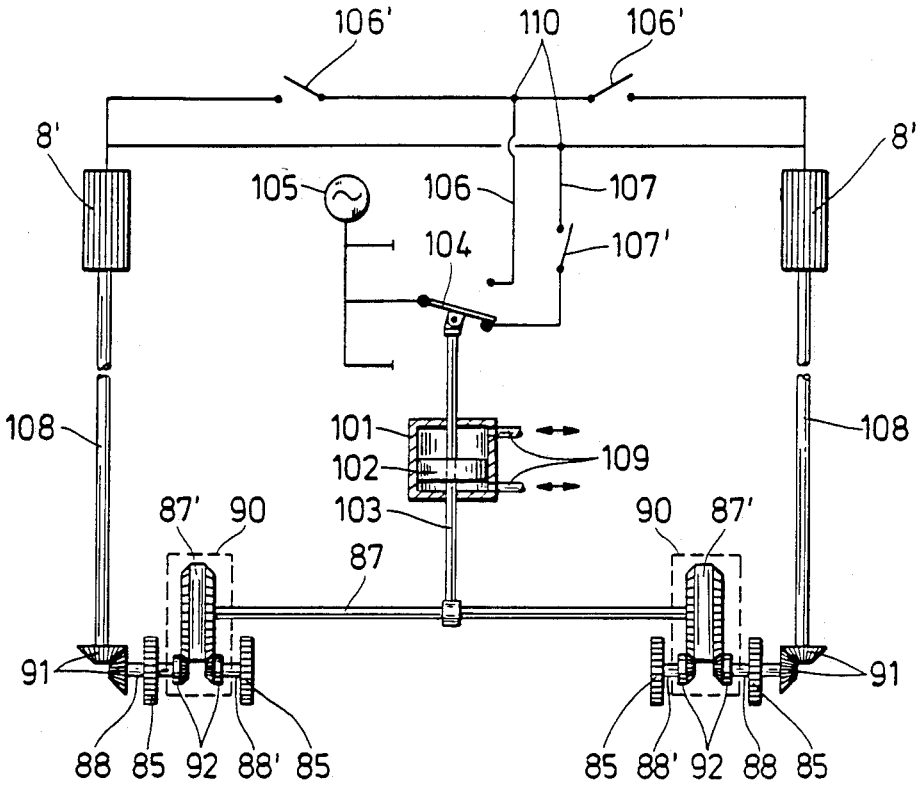

FIG. 7*c* shows details of a drive for the shift device in FIG. 7*a;*

Figure 7D:
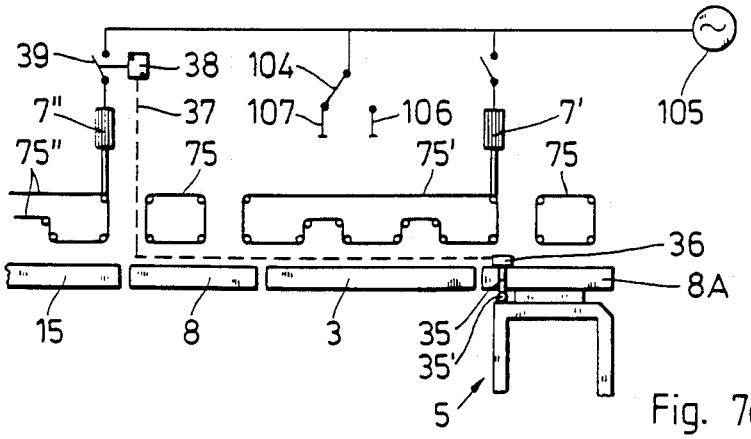
Figure 8A:
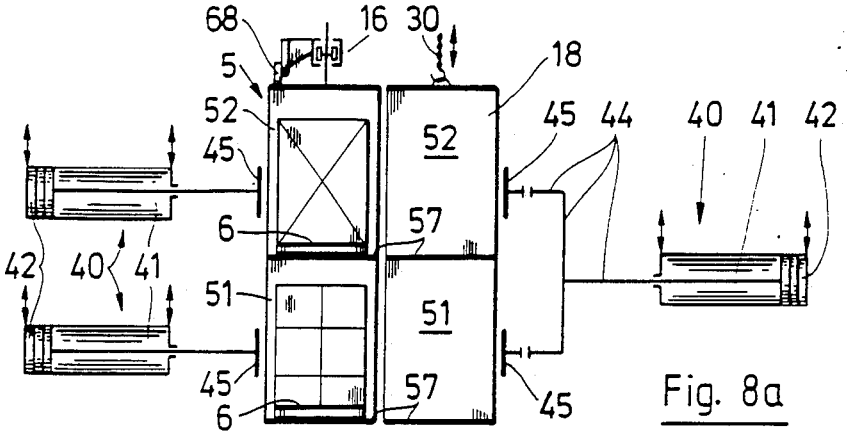
Figure 8B:
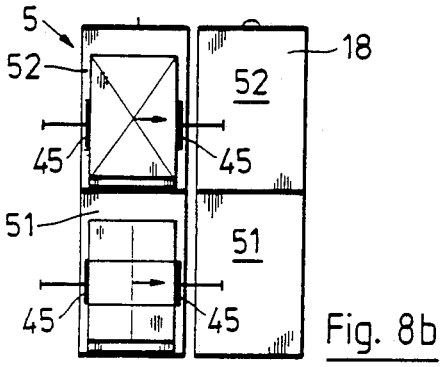
Figure 8C:
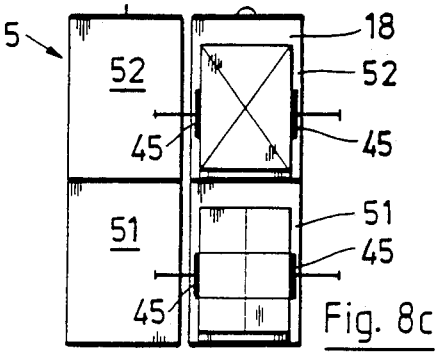
Figure 8D:
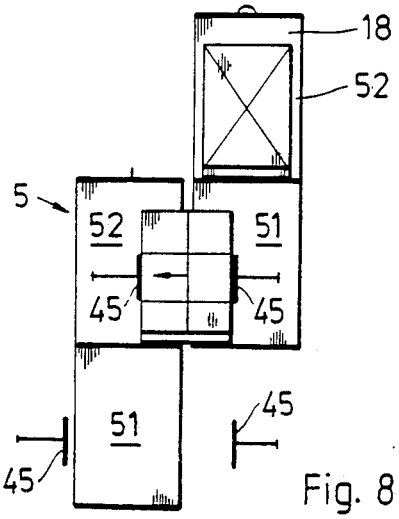
Figure 8E:
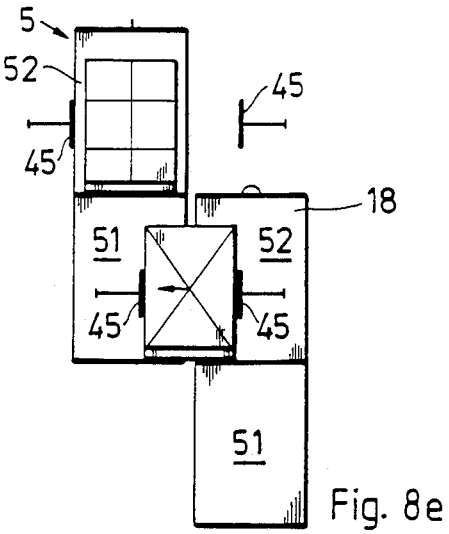

FIG. 7*d* shows details of the control means for the conveyor system which prevents a shift device being loaded when the other shift device is loaded, and FIGS. 8*a* and 8*e* are a diagrammatic example of a change station in an irradiation plant.

FIGS. 1*a* and 1*b* represent an irradiation plant according to the invention comprising a wall-shaped radiation source 2 in an irradiation chamber 1 and a conveyor system comprising four irradiation tracks 3 symmetrical with the chamber 1 and disposed between two transverse tracks 4 and 4A. A number of conveyor units 5 carried and guided by tracks 3 and transverse tracks 4, 4A and each loaded with two superposed pallets 6 containing material for irradiation are driven by chain drives 7 along the various tracks. The transverse track 4 is connected to an entry section 15 and an exit section 16. Each conveyor unit 5 has control elements which act on control-system sensors disposed along the tracks and thus guide units 5 on individual paths along the irradiation tracks 3 and transverse tracks 4, 4*a*. A shift device 8, 8*a* moves along each of the transverse tracks 4, 4*a* from and to the ends of the various irradiation tracks 3, parking tracks 31, and the entry section 10, 15 and exit section 11, 16. A drive 100 drives the shift carriages 8, 8*a* always together and in the same direction, so that they are always facing one another. Controlled locking devices (not shown in FIGS. 1*a* and 1*b*) prevent the shift devices 8, 8A from being both loaded with a conveyor unit 5 at the end of the process of loading or unloading a shift device 8 or 8A. The irradiation chamber 1 is surrounded by a concrete casing which protects the environment e.g. from radioactive $\alpha$, $\beta$ or $\gamma$ rays from wall 2 and is connected to the wall by an entry labyrinth 10 and an exit labyrinth 11. Outside the irradiation chamber 1, the conveyor system 12 travels through an unloading station 13 where the pallets 6 and irradiated material are unloaded from conveyor units 5, and a loading station 14 where the conveyor units 5 and pallets 6 of material for irradiation are loaded on to units 5. Units 5 travel along the entry section 10 and connecting track 15 to the shift carriage and the irradiation tracks 3. The exit section 16 extends through a change station 17 in which pallets 6 superposed on conveyor surfaces can be changed . . . a lift 18 and a lift shaft 19 are disposed underneath. The entry and exit sections 15, 16 have the same construction as the irradiation tracks 3. A container 20 filled with water is provided under the radiating wall 2 and the radiation source 2 can be lowered by a hoist 21 into chamber 20, to provide a screen against radiation. This is necessary if maintenance staff have to enter the irradiation chamber.

Drive motors 7', 7'' are disposed on the concrete casing 9 for the chain drives 7 near the irradiation tracks 3 and near the entry and exit sections 15 and 16. The two drive motors 8' for the shift devices 8, 8A drive their chain drives. The motor 18' for lift 8 and the drive 21' for the hoisting unit 21 of radiation source 2 are likewise disposed on the roof of concrete casing 9 outside the radiation area of source 2, thus greatly facilitating maintenance.

Each conveyor unit 5 in the irradiation chamber can travel e.g. along a path shown in FIGS. 2*a* to 2*f* along the irradiation tracks 3 and transverse tracks 4, 4A on the shift devices 8. The path is chosen in dependence on the desired intensity, duration and dose of radiation. Combinations of the illustrated paths are also possible. Advantageously, units 5 are driven at a constant average speed.

FIGS. 3*a*, 3*b* and 3*c* show the construction and arrangement of the radiation source 2. In the example shown, it comprises two substantially this parallelepipedal walls movable vertically along two rails 23, individual radiation sources being enclosed in modular manner in the walls 22. The height of wall 22 is less than half the conveyor unit 5 (FIG. 1*b*), so that the vertical position of walls 22 can be varied to obtain an optimum distribution of radiation on the article to be irradiated. A horizontal shaft 25 rotatable in two rolling bearings 24 is disposed along the top end face of each wall 22 and pinions 27 are secured by pins 26 (FIG. 3*c*) to each end of shaft 25 and engage chains 28 disposed on the inside of rails 23. This prevents the radiation source 22 from tilting or jamming. The guidance of radiation source 22 is further improved by two pairs of wheels 29 moving on the inner surface of rails 23 and rotatably secured near the bottom of radiation source 22. Hoist 21 is connected by a steel cable 30 to the radiation sources 22. In their lowest positions (FIG. 3*b*) inside basin 20, the two radiation sources 22 are disposed side by side, thus greatly reducing the dimensions of container 20. Alternatively, racks can be used instead of chains 28.

The construction of the conveyor units 5 is shown in FIG. 4. Each conveyor unit 5 substantially comprises an aluminium box 50 which defines two approximately cubical chambers disposed one above the other, i.e. a bottom chamber 51 and a top chamber 52, the chambers having conveyor surfaces 57 and two sides open to the tracks. A coupling member 53 is secured to the top of box 50 and two pairs of rollers 54 are secured to member 53. Member 53 has two upwardly open grooves 55 separated by a space z. Track 3 comprises two "U"-shaped bearers 3' having their open sides facing one another and separated by a space somewhat greater than the thickness of coupling members 53. Rollers 54 run on the inside of bearers 3'. Conveyor units 50 are suspended by coupling member 53 and run on rollers 54 on tracks 3. Cams of the drive system engage in slots 55.

On the floors or conveyor surfaces 57 of each chamber 51, 52 there are two rows of rollers 56 on which the pallets 6, mounted on an aluminium or steel undercarriage 58, are moved. A braking and holding device 60 for retaining the pallets 6 and undercarriages 58 is disposed between rollers 56, e.g. in the middle of conveyor surfaces 57. A rod 61 for actuating the brake 60 is movably disposed in a wall of box 50 and projects from the wall in the upper part of the box. At its top end, rod 61 has a pressure plate 62. A compression spring 63 operates between plate 62 and the roof of box 50 and presses the rod 61 upwards. A rotatable round rod 64 is mounted in each conveyor surface 57 and is permanently connected at one end to a lever 65 and at the other end to a gearwheel 66. Lever 65 is pivotably connected to rod 61, and gearwheel 66 cooperate with a rack 67 permanently connected to the brake 60. If rod 61 is pressed downwards against spring 63, brake 60 is lowered and pallets 6 can be unloaded or loaded. In the example shown, the brakes are released by one of the pressure rollers 68 secured to one of the "U" bearers 3' and acting on the pressure plates 62.

Each conveyor unit 5 has control elements which in the present example are in the form of engageable and disengageable levers 70 secured at the top of box 50 and optionally act on the control means via switches 71 secured to the "U" bearers 3'. As shown in FIGS. 5*a* and 5*b*, levers 70 are rotatably disposed in a bearing structure 72 permanently connected to box 50, and in which a spring-loaded push rod 73 acts on each lever 70 so that the lever 70 is firmly held in one or the other of two stable positions. In the disengaged position, levers 70 act on the associated switches 71 (FIG. 5*a*) whereas in the engaged position they move past the corresponding switches 71, which are the sensors of the control means. In the conveyor system, therefore, switches or sensors 17 of the control means are disposed e.g. along the tracks at each junction. In the loading station 14, the individually selectable irradiation path for each conveyor unit 50 is set by the operators, using levers 70. Levers 70 and/or switches 71 can be multiple, thus further improving safety.

The grooves 55 of the coupling members 53 co-operate with cams 79 of drive chains 75 for the conveyor units 5. FIG. 6 shows four pinions 76 of the drive system 7. The drive chain 75 has five cams 79 which engage in grooves 55 of the coupling members 53 of the conveyor units 50. Chain 75 and cams 79 are designed and disposed so that at least one of them always engages in a groove 55, so that unit 5 is always guided via the coupling member 53. Chain 75 is driven e.g. via a bevel gear on a shaft 76' driven by a drive bevel gear which is driven by the shaft of a drive motor extending through the roof of the concrete casing 9. Each pair of adjacent drive chains 75 are separated by the same spacing z as between the grooves 55 of the coupling member. Drive chains 75' in FIG. 7*a* are constructed so that a single chain can simultaneously drive a number of conveyor units 5 on a track.

FIG. 7a also shows the shift device 8, which can bear a single conveyor unit 5. Each shift device 8, 8A contains a track 3 made up of "U" bearers 3'. The top ends of bearers 3' are held together by two reinforced sheet-metal walls 80. Two wheels 81 are secured to each wall 80 and run on rails 4' of the transverse track 4 or 4A. The shift device 8, 8A is guided so that the ends of bearers 3' reach near enough to the irradiation tracks 3, parking tracks 31 and entry and exit sections 15, 16 for the conveyor units to be able to change over from one track to another. Each shift device 8, 8*a* e.g. has a chain drive 7 for conveying the units 5 to the respective tracks. Walls 80 each have a passage 82 for the coupling members 53 of units 5.

The drive 100 (FIG. 1) of the shift devices 8, 8*a* is e.g. via tension chains 83, 84 guided on wheels 85. In the case both of tension chain 83 and drive chain 84, one of the wheels 85 is secured to a tension spring 86 on the wall of the concrete casing 9. The other wheel 85 of chain 83 is connected to a shaft portion 88' and the other wheel 85 of chain 84 is connected to a drive shaft 88. Shaft portion 88' and drive shaft 88 are interconnected via a coupling 90, and shaft 88 is driven via bevel gears 91 by the shaft 108 of motor 8' extending through the roof of the concrete casing 9. All the wheels 85 can have the same construction.

The drive chain 84 bears another wheel 93 secured to the shift device 8, 8A and is guided on two pinions 94. As FIG. 7*b* shows, a wheel 93 secured to the shift device 8, 8A drives the drive chain 7 via a transmission 95, a pinion 96, an auxiliary chain 97 and a pinion 98.

As FIG. 7*c* shows, each coupling 90 comprises two similar bevel gears 91, one permanently connected to the drive shaft 108 and the other to the shaft portion 88, and a movable double bevel gear 87' which, in the coupled position, engages the two bevel gears 92. The double bevel gears 87' of the two couplings 90 are rotatably mounted on a connecting shaft 87 which is connected to a piston rod 103 and a piston 102 movable in a cylinder 101. Piston rod 103 extends through piston 102 to a switch 104. Switch 104 connects an electric power source 105 optionally to one out of two electric lines 106 or 107. Each line 106, 107 has a junction 110 and leads to the drive motors 8' of the two shift devices 8, 8A. One line 106 has a switch 106' between the junction 110 and each drive motor 8', whereas the other line 107 only has a switch 107' between switch 104 and junction 110. Cylinder 101 has two connections 109 for actuating the e.g. pneumatic pressure switch via piston 2.

Instead of having the connecting shaft 87 and the piston rod 103, the couplings 90 and switch 104 could be actuated in synchronism by purely electric or pneumatic or hydraulic means or combinations thereof.

The drive of the conveyor system shown in FIGS. 7*a*, 7*b* and 7*c* operates as follows:

When coupling 90 is disengaged, the drive motor 8' (not shown in FIG. 7*a*) drives the shafts 88 via bevel gears 91. Each shaft 88 drives chain 7 via one of the sprockets 85, one of the drive chains 84, sprocket 93, transmission 95, pinion 96, auxiliary chain 97 and pinion 98, and thus drives the conveyor unit 5 in shift device 8, 8A. When the couplings 90 are engaged, the tension chains 83 are driven via sprockets 85 and consequently the two shift devices 8 and 8A are moved along the transverse tracks 4, 4A. Since the tension and drive chains 83, 84 are now running at the same speed and in the same direction, the speed of each drive chain 84 relative to the sprocket wheel 93 connected to the shift carriages 8, 8A is zero, so that wheel 93 remains effectively braked. Consequently, unit 5 cannot move. This automatically prevents the conveyor units 5 extending out of a moving shift carriage 8, 8A. It is only after the coupling 90 has disengaged that carriages 8, 8A are stopped and units 5 can be moved.

In FIG. 7*c*, coupling 90 is engaged and piston 102 and consequently piston rod 103 and the shaft 87 connected thereto are in an end position. Consequently the two double bevel gears 87' are in engagement with the associated two bevel gears 92. Switch 104, which is likewise connected to piston rod 103, is switched so that the current source 105 is connected to line 107' and switch 107. Consequently, the two drive motors 8' can be switched on or off only in synchronism. In order to disengage the couplings 90, piston 102 is brought into the other end position, when the double bevel gears 87' are no longer in engagement with bevel gears 92. Switch 104 is simultaneously changed over and now connects the current source 105 to the line 106 having two switches 106', so that the drive motors 8' can be individually actuated in order optionally to load a conveyor unit 5 on to one or the other shift device 8, 8A. FIG. 7*c* shows only a simple form of a suitable circuit, but there are a number of other circuits equally suitably for the conveyor system. Advantageously the circuit should be constructed so that coupling 90 can be released only if the shift devices 8, 8A are in line with an irradiation track 3 or parking track 31. To prevent accidental movement of devices 8, 8A, the devices can be fitted with brakes which can be released only when coupling 90 is engaged and motors 8' are switched on. Reversing switches must also be available for enabling motors 8' to run in both directions of rotation.

To ensure that the conveyor system is operating efficiently, a control means of the conveyor system overriding the aforementioned electromechanical system must ensure that after every loading or unloading process, not more than one of the facing shift devices 8, 8A is loaded with a unit 5. This can be done by means of locking devices which prevent a shift device 8, 8A from being loaded or unloaded as soon as the aforementioned condition is not fulfilled. To this end, the conveyor system can have a network of sensors which are disposed on the track junctions and the various shift devices 8, 8A and constantly report the loading situation of the tracks and shift carriages e.g. to a monitoring unit which can be a computer. The control unit can operate on devices for locking the conveyor units, which can be disposed along the tracks and on the shift devices 8, 8A.

One possible arrangement of locking means is diagrammatically shown in FIG. 7d. In this embodiment, locking is brought about in that some drive chains 75, 75' are not operated when the shift devices 8, 8A are loaded in a certain manner of, if the tracks and shift devices 8, 8A are loaded differently, a conveyor unit 5 first has to be unloaded by a shift device 8, 8A, depending on the path to be followed by units 5.

The locking device comprises signal generators 36 disposed as near as possible to the irradiation tracks 3 and which can be acted upon e.g. by rollers 35' of units 5 secured to rods 35. Signal generator 36 is connected by a signal line 37 to a monitoring and control unit 38 which in the case shown prevents device 8 from being loaded as long as device 8A is loaded with a conveyor unit.

To prevent the cams 79 meeting the coupling members 53 outside slots 55, the drive motors 7', 7", 8' should operate in synchronism or a sequence control system must be provided.

The conveyor system can also have horizontally or obliquely disposed chains which co-operate with coupling members 53 mounted at other places on units 5. Slots 55 may also be sloping or curved, to avoid jerky movements.

In order to irradiate the articles in units 5 as uniformly as possible, it may be necessary not only to vary the vertical position of radiation source 22 when chamber 1 is closed, but also to change over the pallets 6 superposed on the conveyor surfaces. This purpose is served by the change station 17 and lift 18, which are explained with reference to FIGS. 8*a* to 8*e*. As FIG. 1*b* shows, lift 18 is suspended from a steel cable 30 extending through the roof of concrete casing 9. Motor 18" drives the winch 18' of the lift. Lift 18 is guided on rails and is movable upwards and downwards in a separate lift shaft 19. Lift 18 is substantially an aluminium box similar to units 5 and can also have rollers and a brake for the pallets. Pressure rollers 68 for adjusting the brake are disposed in the lift rails and operate via a lever system on the rod 62 of brake 60. Lift 18 is so designed so that e.g. conveyor units travelling on the exit section 16 can be driven very close so that the two chambers 51, 52 of the lift are opposite the chambers of the conveyor unit. The change station 17 also comprises e.g. three double-acting hydraulic cylinders 40 having piston chambers 41, 42 which can be optionally pressurized. Each piston 43 is connected to on end of a spindle 44, at the other end of which one or more slides 45 are disposed. Two functionally independent superposed cylinders 40 are disposed so that units 5 come to rest between them and lift 18.

The change station 17 operates as follows:

First, a conveyor unit 5 loaded with pallets 6 is driven to lift 18. A pressure roller 68 is disposed at the entry section 16 in station 17 and, as described, releases the brakes 60 of unit 5 for pallets 6. Slide 45 is then driven against the pallets 6 (FIG. 8*b*), after which the pallets 6 and undercarriages 58 are pushed by slide 45 from unit 5 on to lift 18 (FIG. 8*c*). The two slides 45, which reload a pallet 6 in co-operation, prevent the loads from tipping over. Slides 45 are the brought back to their starting position, so that lift 18 is raised and the bottom pallet 6 can be pushed by two slides 45 from lift 18 into the top chamber of unit 6 (FIG. 8*d*). Slides 45 are then returned to their starting position. Lift 18 is then driven downwards and the top pallet 6 is moved by slides 45 from lift 18 to the bottom chamber 51 of unit 5 (FIG. 8*e*). Finally, slides 45 are returned to their starting position and unit 5 returns to the irradiation tracks in order to continue the irradiation.

In short, the irradiation unit according to the invention operates as follows:

Units 5 in the loading station 14 are loaded preferably each with two pallets 6 and travel in the conveyor system 12 along the entry labyrinth 10 to the irradiation chamber 1, where units 5 are conveyed by system 12 to the beginning of the entry section 15, from where they are conveyed by the chain drive 7 to the shift device 8 and thence to the transverse tracks 4, 4A and the irradiation tracks 3. In the process each unit 5 travels along the path preset in the loading station 14 by engaging and disengaging the levers 70.

In the case of articles which have to be heavily irradiated or for a long time, an intermediate stop in station 17 can be prescribed for changing the pallets 6 and moving the radiation sources 22. At the end of the preset irradiation program, unit 5 is conveyed to the exit section 16 and exit labyrinth 11 towards the outlet and the discharge station 13.

The example shown here relates to a preferred embodiment of the invention, but other embodiments are also possible. More particularly the number of irradiation tracks 3 can be chosen in adaptation to the required irradiation. Also, the drive for the conveyor units and the shift devices can be different, e.g. hydraulic or pneumatic. Instead of suspended rail tracks, other rail systems can be used as guides, e.g. floor rails, moving carpets, or air, gas or liquid cushion tracks. The conveyor units can also be designed for a number other than two pallets, and the pallets can be other than superposed. More particularly, hydraulic lifting blocks can be used as a hoist for the lift (18) and for the radiating wall (2).

The switches and sensors can be electric, electronic, hydraulic or pneumatic. They should if possible be disposed outside the radiation area or be protected against radiation, which is particularly damaging to electric and electronic components. Alternatively the control system can operate on a synchronously operating model of the conveyor system disposed outside the radiation chamber.

In the embodiments, the shift devices 8, 8A are moved only in common and in the same direction and therefore always facing one another. This embodiment is very simple and clear and is therefore frequently preferred. However, in some imaginable embodiments of the plant according to the invention the shift devices 8, 8A can also run independently of one another, in which case the control means must be designed so that a conveyor unit is not pushed to or from one of the radiation tracks 3 unless a shift carriage 8, 8A is a both ends.

In addition, in order to irradiate very long articles, it is possible to use a conveyor unit 5 from which the top conveyor surface can be removed.

I claim:

1. An irradiation plant comprising an irradiation chamber (1) and a conveyor system for conveyor units (5) bearing articles for irradiation and moved past a radiation source (2) the system comprising an even number of irradiation tracks (3) disposed symmetrically to the radiation source (2) and extending between a first transverse track (4) and a second track (4A) each connecting the irradiation tracks (3) at a respective end, and one transverse track (4) being connected to the entry section (10, 15) and the exit section (16, 11) of the conveyor system to and from the irradiation chamber (1), characterised in that each transverse track (4, 4A) comprises a shift device (8, 8A) for loading, unloading and changing over the conveyor units (5) on the irradiation tracks (3) and the conveyor units (5) have control elements (70) for presetting the path of the conveyor unit (5) in the conveyor system and acting on sensors (71) of a conveyor-system control means, and the control means is constructed so that whenever a conveyor unit (5) is loaded on to or unloaded from an irradiation track (3), a shift device (8, 8A) is disposed on each side of the conveyor unit (5), and at the end of each loading or unloading process, not more than one of the two facing shift devices (8, 8A) is loaded with a conveyor unit (5).

2. An irradiation plant according to claim 1, characterised in that the control elements are engageable and disengageable levers (70) secured to the conveyor units (5) and the levers act only in one of these two positions on the sensors (71) disposed along the conveyor paths.

3. An irradiation plant according to claim 1 or 2, characterised in that the radiation source (22) is in the form of a wall, guided by a hoisting device (21) on rails (23), and lowerable into a water container (20).

4. An irradiation plant according to claim 3, characterised in that rack or chain (28) is disposed along each rail (23) and engages a pinion (27) disposed on the radiation source (22).

5. An irradiation plant according to claim 1 characterised in that the radiation source comprises at least two wall-shaped radiators (22).

6. An irradiation plant according to claim 1 characterised in that conveyor units (5) comprise a number of superposed conveyor surfaces (57).

7. An irradiation plant according to claim 6, characterised in that a change station (17) is provided in the irradiation chamber (1) for changing the articles for irradiation on the superposed conveyor surfaces (57).

8. An irradiation plant according to claim 1 characterised in that the conveyor units (5) on each conveyor surface (57) have a releasable securing brake (60), the conveyor surfaces (57) have rollers (56) supporting the bearers (6, 58) of the articles for irradiation, and the bearers (6, 58) are loaded and unloaded on the rollers (56) by co-operating pressure-medium actuated slides (45).

9. An irradiation plant according to claim 1 characterised in that drive chains (55) with cams (79) are available for driving the conveyor units (5) and engage in grooves (55) of coupling members (53) of the conveyor units (5).

10. An irradiation plant according to claim 1 characterised in that each of the two transverse tracks (4, 4A) has a single shift device (8, 8A) and the two shift devices (8, 8A) are driven in the same direction on the transverse tracks (4, 4A).

11. An irradiation unit according to claim 10, characterised in that each shift device (8, 8A) has a drive (7) for the conveyor units (5) and the drive (7) is coupled to the drive (8) of the shift devices (5) so that only one device (5) is operative at a time.

12. An irradiation plant according to claim 1 characterised in that at least one parking track (31) for receiving conveyor units (5) is in the irradiation chamber (1).

13. An irradiation plant according to claim 1 characterised in that the tracks (3, 3, 8, 8A, 10, 11, 15, 16, 31) of the conveyor system are constructed as suspended rail tracks.

14. An irradiation plant accordint to claim 1 characterised in that the radiation source (2, 22) is a radioactive radiation source.

* * * * *

UNITED STATES PATENT AND TRADEMARK OFFICE

CERTIFICATE OF CORRECTION

PATENT NO. : 4,866,281

DATED : Sept. 12, 1989

INVENTOR(S) : ERNST BOSSHARD

It is certified that error appears in the above-identified patent and that said Letters Patent is hereby corrected as shown below:

Column 3, line 56 "this" should be -thin-
Column 6, line 40 "suitably" should be -suitable-
Column 7, line 59 "the" should be -then-
Column 8, line 51 "a" (second occurrence) should be -at-
Column 10, line 33 "accordint" should be -according- Signed and Sealed this Twenty-first Day of August, 1990

*Attest:*

HARRY F. MANBECK, JR.

*Attesting Officer*

*Commissioner of Patents and Trademarks*